United States Patent [19]

Johnson

[11] Patent Number: 4,936,231

[45] Date of Patent: Jun. 26, 1990

[54] SOLID WASTE GARBAGE INCINERATOR SYSTEM

[76] Inventor: Loyd Johnson, P.O. Box 613, Bradford, Ark. 72020

[21] Appl. No.: 392,463

[22] Filed: Aug. 11, 1989

[51] Int. Cl.[5] ..... F23D 14/00

[52] U.S. Cl. ..... 110/235; 110/234; 110/258; 110/210; 110/215; 110/165 R

[58] Field of Search ..... 110/233, 234, 235, 258, 110/259, 210, 211, 215, 165, 169; 126/174, 175

[56] References Cited

U.S. PATENT DOCUMENTS

| | | | |
|---|---|---|---|
| 1,271,398 | 7/1918 | Washburn | 126/174 |
| 3,745,939 | 7/1973 | Allbritton | 110/235 |
| 4,091,747 | 5/1978 | Chase | 110/210 |
| 4,398,998 | 8/1983 | Quame | 110/234 |
| 4,718,357 | 1/1988 | Wang et al. | 110/258 |
| 4,726,302 | 2/1988 | Hein et al. | 110/215 |
| 4,787,321 | 11/1988 | Schnellbacher et al. | 110/258 |
| 4,846,082 | 7/1989 | Marangoni | 110/258 |

*Primary Examiner*—Albert J. Makay
*Assistant Examiner*—Denise L. Ferensic
*Attorney, Agent, or Firm*—Stephen D. Carver

[57] ABSTRACT

An incineration system for processing solid waste refuse. A rigid, upright gas fired furnace reacts waste. The furnace comprises a rigid, generally cubicle outer shell having a rigid firebox disposed substantially concentrically therewithin, and a cooling annulus is defined between the firebox and the shell. The firebox bottom is tapered. Solid waste inputted into the firebox at the top of the furnace falls into the gas fired interior, and wastes are vigorously agitated and split apart by a plurality of rotating spindles. Cooperating, spaced-apart gas manifolds provide a flame front. A vigorously oscillated, shaker grating system disposed beneath the spindles forms a bed upon which flames are directed. During the garbage reduction process the treated residue falls towards down into the tapered bottom of the furnace. Waste hitting the vibrating gratings is separated and agitated for chemical oxidation, and ashes accummulating at the furnace bottom are withdrawn and disposed of as solid waste. During incineration air is drawn into the furnace through a plurality of nozzles in response to vigorous suction. Exhaust gases are drawn out of the furnace through an afterburner system, and turbulence is generated within the furnace to promote efficiency. The afterburner comprises a compartmentalized and baffled manifold disposed between the furnace and associated scrubber apparatus. A pair of afterburner pipes separately connect adjacent manifold compartments with the firebox interior and the surrounding annulus. Gases withdrawn from the manifold by a fan system are subsequently forced through a scrubber for purification.

18 Claims, 4 Drawing Sheets

SOLID WASTE GARBAGE INCINERATOR SYSTEM

BACKGROUND OF THE INVENTION

The present invention relates to the fluidized bed incineration of solid wastes. More particularly, the present invention is directed to an incineration system wherein waste products are thoroughly oxidized, sifted, sorted and outputted in the form of ash, and the burning gases are forced through an associated scrubber apparatus by a suction system.

The prior art reflects numerous attempts to process solid waste. Incineration through fluidized bed treatments systems is also well known. Characteristic of fluidized bed incinerators is Baston patent No. 4,352,332, issued Oct. 5, 1982. Thereshown is a fluidized bed incinerator in which waste subjected to extreme heats may be processed and thereafter filtered in conjunction with waste tank processing and exhaust gas cleaning equipment. Solid waste treatment is also shown in a fluidized bed environment in U.S. Pat. No. 3,776,150 issued Dec. 4, 1973. The latter device conveys solid waste through an auger system into a pair of separate fluidized beds. Baston patent No. 4,359,005, issued Nov. 16, 1982 also discloses a fluidized bed incineration of waste products, wherein a limestone bed is used to prevent phosphorus contamination.

Koyanagi patent No. 3,861,336 depicts an incinerator of the rotary kiln type. Refuse separation and sorting is seen in U.S. Pat. No. 3,650,396. Solid waste is transferred through a plurality of individual processing stages, including pulverization, fluidized bed reaction, and magnetic separation. Certain constituent byproducts are recovered.

In the prior art no known single system integrates all of the features I have found to be necessary for proper processing of solid refuse. The type of processing I am concerned with is directed to solid wastes which are normally disposed of in a landfill. Such solid garbage includes a wide variety of solid waste products, including glass, plastics, paper and the like. No known system can be employed in conjunction with the solid waste dump for reducing the load on the solid waste landfills. Such apparatus must be able to separate and pulverize a wide variety of garbage materials, but it must also be able to properly purify the waste gases and waste water generated during the incineration process.

SUMMARY OF THE INVENTION

The present invention comprises a fluidized bed incineration system which processes solid waste refuse of the type normally disposed of in landfills. After the fluidized bed treatment is completed, relative inert ash byproducts are outputted in solid form. Gases are drawn through a unique communication manifold system from the furnace into a scrubbing station, where they are treated prior to release into the environment.

A rigid, upright gas fired furnace produces the fluidized bed. The furnace comprises an outer casing having a generally cubicle top integral with a lower tapered bottom. A rigid firebox is disposed substantially concentrically therewithin, and a cooling annulus is defined between the outer casing and the firebox. Solid waste is inputted at the top of the firebox into the heated interior thereof, and wastes are vigorously agitated and split apart by a plurality of spindles disposed for rotation in the firebox. A plurality of spaced-apart gas manifolds blast fire into the firebox from within the lower conical regions. A vigorously oscillated, shaker grating system disposed beneath the spindles forms a bed upon which flames are directed. During the garbage reduction process residue falling through the furnace towards the bottom of the firebox temporarily impacts against the gratings. The gratings are vigorously vibrated so that particles are separated and agitated for chemical oxidation, and fine ash residue eventually drops into the furnace bottom.

Ash waste is ultimately received within a lower collection channel. Waste is conveyed outwardly with an unheated rotary auger into an ash output station which is further sifted by another vibrating shaker. Ashes thus outputted from the furnace can be disposed of as solid waste.

During the incineration process gas fuel is vigorously forced into the firebox heating manifolds. Air is concurrently drawn into the firebox and the annulus through a plurality of nozzles defined in the furnace shell in response to vigorous suction. Exhaust gases are drawn out of the furnace to an afterburner system which generates suitable turbulence within the furnace to promote efficiency. Gases are subsequently transferred to a scrubber for purification.

The afterburner system comprises a manifold having twin internal compartments separated by a perforated baffle. The manifold is disposed in fluid flow communication between the furnace and the scrubber apparatus. A first afterburner pipe interconnects the top of the firebox with a first manifold compartment. The second afterburner pipe interconnects the furnace annulus with the other manifold compartment. Both pipes are coupled to the baffled manifold system. An associated fan system vigorously draws gases through the manifold and forces them into the scrubber system.

The scrubber is fed by the fan system, which draws both exhaust gases and a predetermined volume of fresh air into the scrubber. Gases are forced into an elongated, vertical ram pipe, which communicates with a lower reservoir tank. Gases forced down the pipe are subjected to humidifying and spraying through a plurality of individual spray systems for scrubbing. Spray water stored in a recirculating holding tank is recirculated between the sprayers and the tank. Scrubbed gases are eventually vented from the scrubber system. Preferably, spent water is transferred back from the scrubber station to the firebox for disposal.

Thus a broad object of the present invention is to provide a fluidized bed incineration system for processing solid waste refuse.

A similar object is to provide an incinerator system for processing garbage prior to disposal.

Yet another object of the present invention is to provide a highly efficient fluidized bed incinerator for processing waste. It is a feature of this invention that a turbulence-inducing afterburner system associated with the suction producing fans is employed to maximize furnace efficiency.

Another object is to provide a system of the character described which reacts spent scrubbing water by injecting it into the firebox.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
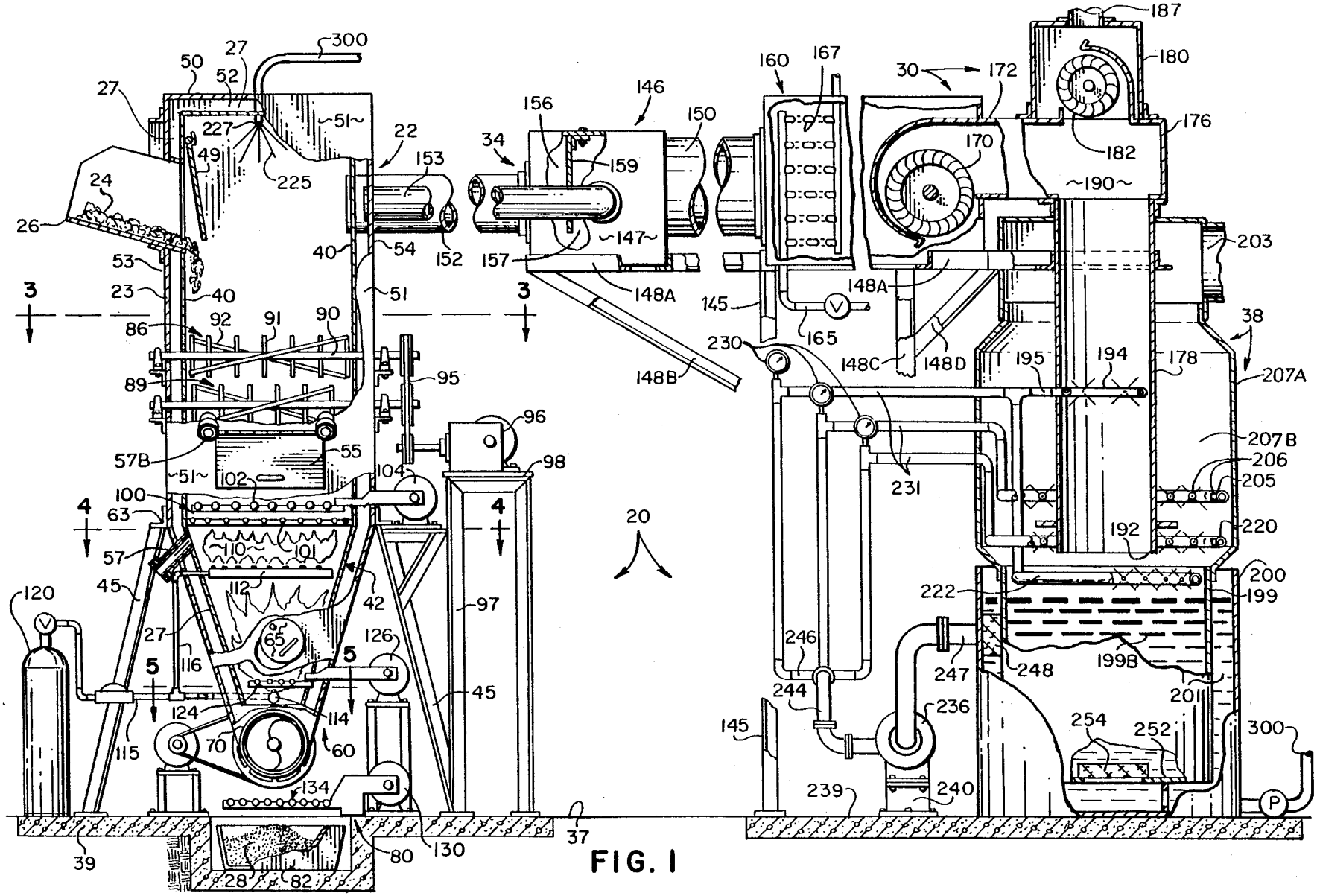
FIG. 1 is a fragmentary pictorial view showing the best mode of my SOLID WASTE GARBAGE INCINERATOR SYSTEM, with portions thereof broken away or shown in section for clarity.

With initial reference directed to FIGS. 1-5 of the appended drawings, a refuse incineration system constructed in accordance with the best mode teachings of my invention has been generally designated by the reference numeral 20. System 20 comprises a generally upright vertically disposed furnace 22 which receives refuse 24 through an inlet ramp 26 for heat processing. Refuse 24 dropping into the interior of the furnace is reacted, and ash 28 is eventually outputted at the furnace bottom. Concurrently with burning of refuse, air is drawn into the furnace 20 by suction applied by a fan system 30 to be hereinafter described. The fan system 30 communicates with the furnace through an afterburner system, generally designated by the reference numeral 34. Waste gases drawn by suction from furnace 22 pass through the afterburner 34 on their way to an associated scrubber system, which has been generally designated by the reference numeral 38.

Furnace 22 is generally cubicle at its top, and it tapers at its bottom. It preferably comprises a rigid, outer shell 23 which surrounds a similarly configured rigid firebox 40. Cooling annulus 27 is thus defined between the shell 23 and the inner firebox. The firebox bottom 42 is tapered and somewhat conical, matching the profile of the furnace. Furnace 22 is disposed upon a supporting surface 37 with a typical concrete slab 39 which receives and mounts a plurality of elongated support struts 45.

The furnace shell comprises a top 50 (FIG. 2), front and rear walls 51 and 52 respectively (FIG. 1), and a pair of rigid side walls 53 and 54. Upper inspection plate 55 defined in front wall 51, and the lower plate 65, facilitate inspection of the interior. A plurality of air injector pipes 57 are attached to surfaces of the furnace to admit air into the firebox (through the annulus 27) for burning. Pipes 57B admit air into the annulus 27. As will be explained in detail hereinafter, air is drawn into the firebox by suction from the fan system. Solid refuse dropped into the chute 26 will deflect an internal damper 49 and drop downwardly into the interior of the furnace.

The bottom portion of the furnace has been generally designated by the reference numeral 60 (FIG. 1). Portion 60 tapers towards its bottom, and it includes a firebox portion surrounded by a shell portion with annulus 27 therebetween. It includes a plurality of sidewalls forming a junction with the bottom of the furnace 22, which junction is preferably reinforced with brackets 63 associated with support stanchions 45. The interior of the conical end of bottom portion 60 is thus in fluid flow communication with the interior of the upper firebox. Materials dropping through the furnace will be reduced to ashes, and ashes will tend to collect at the bottom of the conical portion, within the auger housing 70 (FIG. 2).

Figure 2:
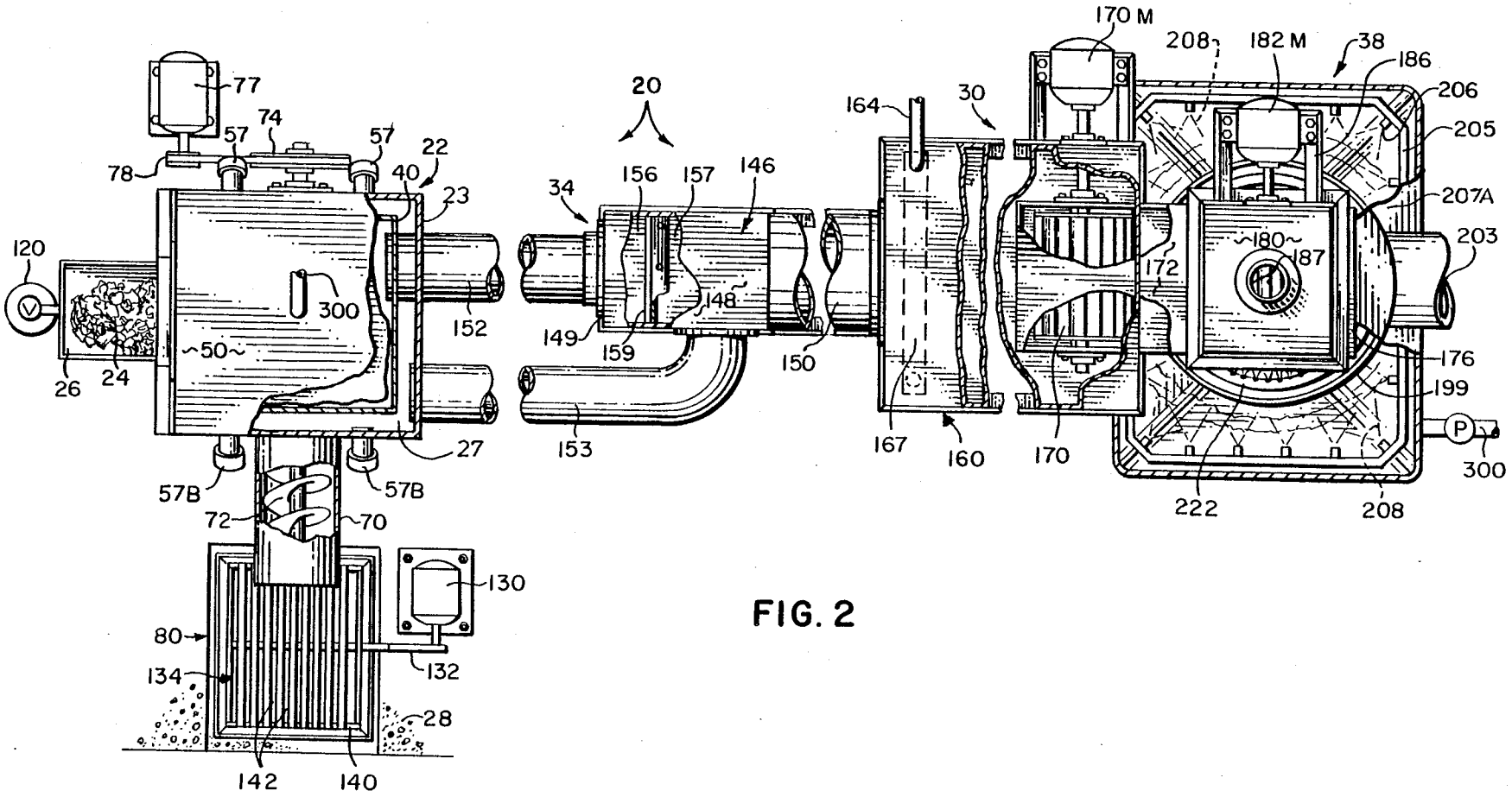
FIG. 2 is a fragmentary top plan view of my SOLID WASTE GARBAGE INCINERATOR SYSTEM, with portions thereof broken away or shown in section for clarity.
Figure 5:
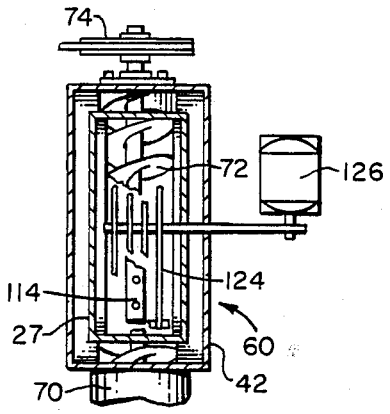
FIG. 5 is an enlarged, fragmentary sectional view taken generally along line 5—5 of FIG. 1.

With particular reference to FIGS. 2 and 5, a transverse auger, generally designated by the reference numeral 72 extends all the way across the lower firebox within furnace bottom portion 60, terminating in a pillow block 73 and a pulley 74 Auger 72 is driven by motor 77 via conventional belts 78. Outputted ash 28 is thus withdrawn from the furnace and dropped through a shaker table 80 (FIG. 2) to be hereinafter described and collects in a suitable container 82.

Figure 3:
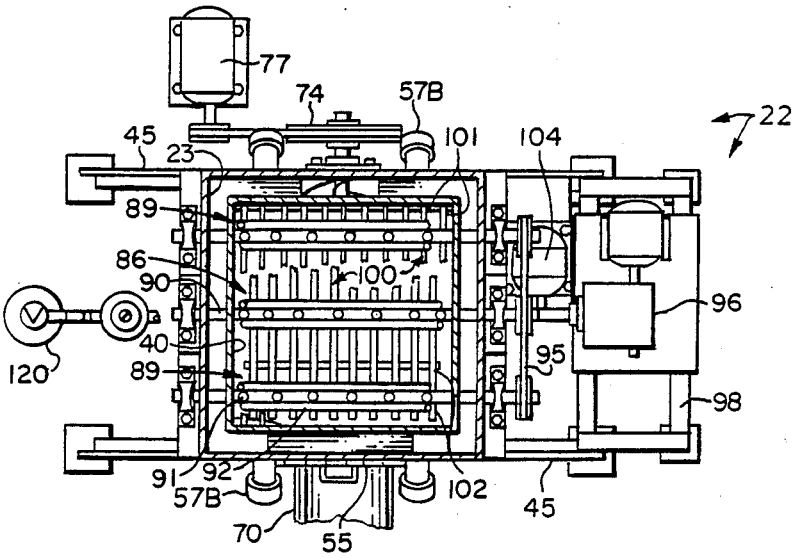
FIG. 3 is an enlarged, fragmentary, sectional view taken generally along line 3—3 of FIG. 1, with portions thereof broken away or shown in section for clarity.
Figure 4:
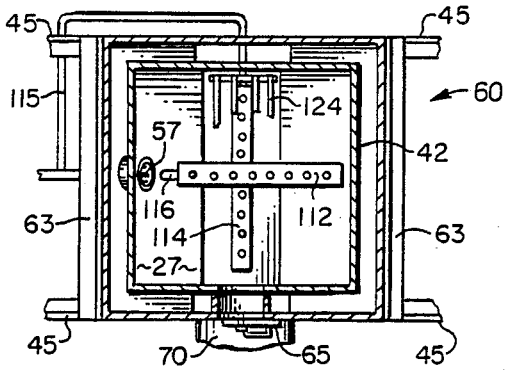
FIG. 4 is an enlarged fragmentary sectional view taken generally along line 4—4 of FIG. 1.

With reference now to FIGS. 1 and 3, rotatable spindles 86 and 89 are journaled for rotation through the firebox, and extend between its sides. As viewed in FIG. 3, a single spindle 86 overlies a pair of lower, spaced-apart spindles 89. As seen in FIG. 3, each spindle includes a central axle 90, including a plurality of spaced-apart disks 91 which support the spiraled arms 92. Waste originally dropping upon these spindles is vigorously agitated since these spindles are driven by a belt 95 in response to a drive motor 96. Motor 96 is disposed upon a pair of support stanchions 97 which support cross brace 98. Thus as motor 96 operates, the spindles 86, 89 are vigorously rotated and the refuse is chopped up and separated. It thereafter drops down and impacts against a grating system generally designated by the reference numeral 100.

Grating system 100 comprises a fixed plate 101 rigidly extending between the side walls of the firebox generally parallel to upper plate 102. The upper plate 102 is free to move laterally across the furnace, and it is forcibly oscillated back and forth by an associated motor 104. Grating plates 101 and 102 each comprise a plurality of parallel, spaced-apart struts which form a grill. Motor 104 vigorously oscillates plate 102 backwards and forwards across plate 101, and particles are separated prior to dropping into the flame 110 immediately therebelow.

Particles move into the flame region 110 immediately above a gas element 112. Element 112 includes a plurality of output burners which direct flame upwardly in the directions indicated. The heating element 112 extends generally across the lower conical portion, and it is spaced-apart above a lower heater 114 which is oriented between the front and back of the lowermost firebox portion. Both heaters are fed through gas lines 115, 116 from a gas source 120. A grating !24 similar to grating 100 is driven by an associated motor 126. It is preferably disposed beneath element 112, but above heater 114. Particles are dropped through the vigorously oscillating grating 124 into the auger housing 70, for conveyance out of the furnace. Particles exit the auger housing 70 and drop onto shaker table 80.

With reference to FIG. 2, shaker table 80 functions as a final sifter. It includes a motor 130 coupled by a suitable linkage 132 to the grating plate 134. Plate 134 is vigorously moved from side to side by the motor, to further sift ashes dropping from the conveyor. Most of the fine particulate matter 28 merely drops through this plate for collection in container 82. Larger particulate objects which cannot drop through the grating may be removed for separate disposal. Each of the gratings 100, 124 essentially are arranged similarly to sifting grater 134. As seen in FIG. 2, the generally rectangular frame 140 of the grating includes a plurality of spaced apart, parallel bars 142 which accomplish the sifting.

Afterburner 34 interconnects the furnace 22 with the scrubber station 38. The afterburner 34 comprises a rigid, generally cubicle box-like manifold 146 having a front 147, a top 148, and a left end 149. The output of manifold 146 is coupled by a large diameter conduit 150 to the fan station. Exhaust pipes 152 and 153 interconnect the furnace 22 with the manifold 146. Suction applied to the manifold through conduit 150 is thus applied to the firebox via the manifold and pipe 152. Manifold suction is applied to annulus 27 by pipe 153. Manifold 146 is preferably supported above ground by a rigid, generally horizontal support 148A associated with the scrubber system 38 by an angularly disposed reinforcement brace 148B. Stanchion 145 also braces and supports the afterburner system.

With reference now to FIGS. 1 and 2, afterburner manifold 146 is divided into separate, adjacent chambers 156 and 157 by an internal partition plate 159. As viewed in FIG. 1, partition plate 159 is disposed off center, substantially to the left of the manifold center. Thus compartment 156 is of a lower volume than adjacent manifold compartment 157.

The preferred dimensions of the manifold 146 are fourteen by twenty by twenty inches. In the best mode pipe 152 is eight inches in diameter, and pipe 153 is seven inches in diameter. The partition plate 159 divides the manifold into two interior volumes such that compartment 156 comprises approximately forty percent of the manifold internal volume, and compartment 157 occupies approximately 60 percent. The compartment volume ratio is thus approximately 2:3.

Compartment 156 is coupled in fluid flow communication directly to the furnace interior by the straight exhaust pipe 152. The longer, L-shaped pipe 153 extends from the furnace alongside the manifold past the partition plate, and curves around to couple to the manifold front wall 147. Internal manifold compartment 157 is thus separately coupled to the furnace annulus 27 to draw cooling air around and through it. This relatively fresh, preheated air drawn through the annulus 27 is admitted into the manifold adjacent the perforated partition plate, and it further provides oxidizer for the flame front drawn through pipe 152 into manifold compartment 156.

Suction applied by the fan system through pipe 150 will thus generate severe turbulence within the manifold, and through the construction I have disclosed similar intense spinning air turbulence is created by suction at the top of the furnace. The hot flame front within the firebox is vigorously swirled to rapidly oxidize the furnace contents. Thus the vacuum tension applied to the furnace via pipes 152 and 153 promotes combustion and efficiency.

Thus hot exhaust gases are withdrawn from the furnace through the manifold via pipe 150. Pipe 150 is interconnected with the scrubber station 38 via a fan system, generally designated by the reference numeral 30. Fan system 30 comprises a rigid, generally cubicle plenum 160 supported above ground by braces 148A, 148C, 148D (FIG. 1). Exhaust gases entering plenum 160 are precooled by passage through a circulating-water heat exchanger 164 (FIG. 2). Heat exchanger 164 passes water through a line 165 and its heat exchange core 167 so that gases passed therethrough will be cooled. Gases are first drawn with the vigorous action of the squirrel cage fan 170 and forced out through duct 172 into a shroud 176 disposed at the top of the scrubber ram pipe 178. A generally cubicle cap 180 disposed at the top of the shroud 176 encloses a cooperating squirrel cage fan 182 which draws ambient air through an upper orifice 187. Fans 170 and 182 are respectively driven by motors 170M and 182M (FIG. 2). Motor 182M is supported by suitable offset braces 186 associated with shroud 176. Thus the input region 190 (FIG. 1) of the scrubber system will receive hot precooled exhaust gases from the furnace from fan 170, and a measure of fresh air from fan 182. In the preferred embodiment the volume ratio between hot exhaust gases and inputted fresh air on pipe 182 is approximately 3:5. Fan speed is approximately 1700 RPM.

Because of the high gas pressure at region 190 at the top of the ram pipe 178, hot gases will be vigorously forced down the ram pipe toward bottom end 192 from which they will escape. However, scrubbing is accomplished by an internal humidifying nozzle 194 controlled through line 195 which sprays water interiorly of pipe 178. Pipe 178 is generally concentrically oriented with respect to a lower holding tank 199. Tank 199 forms an irregular annulus 201 relative to the outer casing 200, and water will be disposed in the interior 199B of the tank and within the water annulus 201 (FIG. 1). A degree of back pressure is maintained by external gas vent 203, which vents the shroud 207A to atmosphere.

An upper sprayer manifold of generally rectangular outer dimensions has been generally designated by the reference numeral 205. Manifold 205 includes a plurality of nozzles 206 which direct a spray 208 towards the annulus 207B formed between the pipe 178 and shroud 207A. Gases exit from pipe 178 into shroud into annulus 207B. A lower manifold 220 directs spray in this region. A lower, generally circular manifold 222 (FIG. 1) directs spray in a plurality of directions in that region immediately beneath ram pipe 178 and the liquid head below. The manifolds are separately controlled by a plurality of valves 230 which transmit on lines 231 into the manifolds. Pump 236 which is suitably braced upon a slab 239 and mounted on a frame 240 supplies high pressure feedwater on pipe 244 to manifold 246. Water is withdrawn from annulus 201 through a pipe 247 and a filter element 248 disposed within annulus 201. Water reaching the bottom 252 of tank 199 is transmitted through a filter 254 into the annulus 201.

As the system continues to operate the waste water will become increasingly concentrated with waste gas particles and dissolved chemicals and solids. When it reaches approximately 60% saturation it may no longer be suitable for scrubbing, and it is fed into the furnace for disposal. An exhaust line 300 from tank 199 is powered by a suitable pump P to force water through the top of the furnace into the firebox, which results in a spray 225 directed into the firebox interior via nozzle 227.

Figures 6, 7:
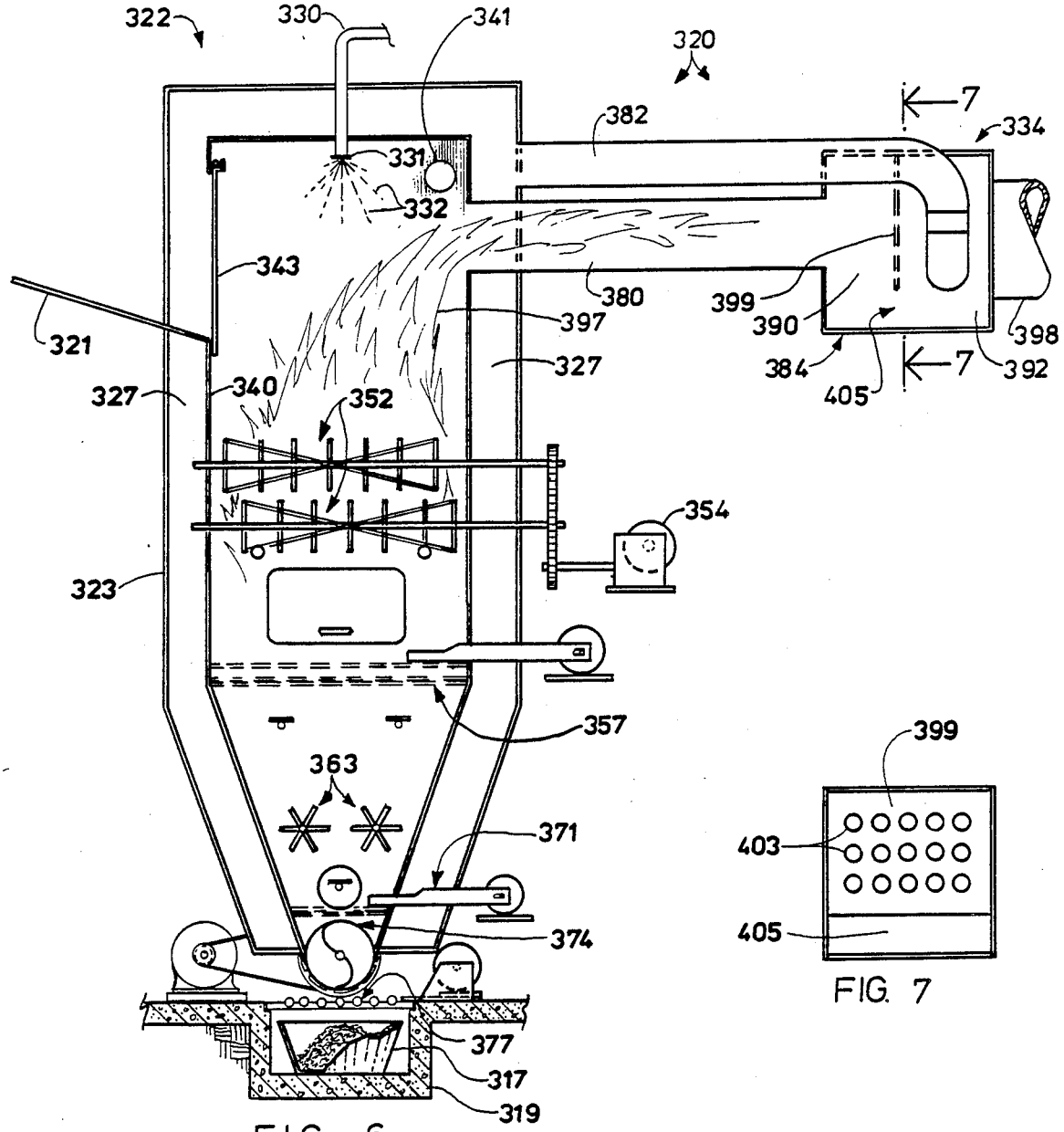
FIG. 6 is a fragmentary plan view of an alternative embodiment, with portions thereof omitted for brevity; and, FIG. 7 is an enlarged fragmentary sectional view taken generally along line 7—7 of FIG. 6.

With reference now to FIGS. 6 and 7, an alternative embodiment of my system of larger dimension suitable for high volume applications has been generally designated by the reference numeral 320. It is operatively disposed upon a suitable concrete support slab 319. Rack 321 extends through casing 323 and annulus 327 and is rigidly attached to firebox 340. Door 343 is deflected to admit refuse loaded onto rack 321. Pipe 330 transmits waste water from the scrubbing system (not shown) through nozzle 331 into the firebox interior forming a spray 332. Furnace 332 also includes a pair of internal rotatable spindles 352 within its interior, driven by a suitable motor 354. A grating system 357 is disposed beneath spindles 352. However, in the lower conical regions of the fire box, a pair of spindles 363 are disposed generally transversely in relation to upper spindles 352. Materials dropping through spindles 363 are sifted through a reciprocating grating system 371 and is finally sifted by grating 377 as it is conveyed out of the apparatus.

Suction manifold 334 in the afterburner system is coupled to the furnace by a pair of pipes 380, 382. Manifold 384 is divided into a first compartment 390 separated from an adjacent compartment 392. Pipe 398 leads to a fan station and scrubber station similar to that described previously. Thus pipe 380 intercommunicates the firebox interior with manifold compartment 390. The longer and the smaller-diameter arcuate pipe 382 intercommunicates manifold compartment 392 with annulus 327. Annulus 327 is in fluid flow communication with the firebox interior via a vent orifice 341. Thus the flame front 397 rising upwardly through the firebox is drawn into pipe 380, and flame impacts the partition plate 399 disposed within manifold 384. Hot gases exhausted from vent orifice 341 and cooling gasses drawn through the annulus are sucked into the manifold by pipe 383.

Preheated air entering the manifold through pipe 382 provides a source of oxidizer through the flame front impacting perforated partition plate 399. Particle dispersion is further enhanced by orifices 403 in plate 399 (FIG. 7). Plate 399 terminates short of the bottom of the manifold 394, leaving a clearance void 405 at the bottom of the manifold between the adjacent compartments. Material dropping through furnace 322 passes internal rotating spindles 363 and drops upon and through grating 371. Waste ashes are conveyed outwardly of the furnace via auger 374, and are then dropped through external grating 377 prior to collection in bucket 317.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An incineration system comprising:

a rigid, upright furnace adapted to be disposed upon a supporting surface, said furnace comprising:

a rigid, outer casing;

a rigid firebox generally concentrically disposed within said casing;

a cooling annulus defined between said outer casing and said firebox;

an input for receiving refuse to be incinerated;

a lower ash output for exhausting processed waste;

spindle means disposed within said firebox for forcefully agitating refuse dropped thereon;

grating means for sifting residue and ash, said grating means disposed within said firebox beneath said spindle means;

a plurality of gas heaters disposed within said firebox for burning said refuse; and, auger means disposed at the bottom of said firebox for conveying spent ashes outwardly of said furnace;

afterburner means for withdrawing exhaust gases from said furnace, said afterburner means comprising a baffled manifold coupled to said furnace and comprising a rigid enclosure divided into first and second adjacent, interior compartments by a perforated partition plate, and said afterburner means further comprising a first pipe extending between said firebox and said manifold first compartment and a second pipe extending between said annulus and said manifold second compartment;

scrubber means for cleaning exhaust gases withdrawn from said afterburner means, said scrubber means comprising:

a water recirculating tank;

an elongated ram pipe in fluid flow communication with said recirculating tank;

means for spraying water to scrub gases transmitted by said ram pipe;

means for recirculating water between said recirculating tank and said means for spraying; and, fan means for withdrawing gases from said manifold and forcing gases down said ram pipe into said scrubber system.

2. The incinerator as defined in claim 1 wherein said second pipe is longer than said first pipe.

3. The incinerator as defined in claim 2 wherein said first manifold compartment is disposed between said second manifold compartment and said first pipe.

4. The incinerator as defined in claim 3 wherein the diameter of said first pipe is greater than the diameter of said second pipe.

5. The incinerator as defined in claim 4 wherein the volume of said first manifold compartment is less than the volume of said second manifold compartment.

6. The incinerator as defined in claim 4 including heat exchanger means disposed between said second manifold compartment and said fan means for precooling gases to be scrubbed.

7. The incinerator as defined in claim 1 wherein said grating means comprises a fixed plate and an oscillating plate slidably disposed over said fixed plate.

8. The incinerator as defined in claim 1 including means for withdrawing spent water from said recirculating tank and inputting it into said furnace for disposal.

9. An incineration system comprising:

a rigid, upright furnace adapted to be disposed upon a supporting surface, said furnace comprising an input for receiving refuse to be incinerated and a lower ash output for exhausting processed waste, and said furnace comprising:

a rigid outer casing;

a rigid firebox disposed within said casing;
a cooling annulus defined between said casing and said firebox;
spindle means disposed beneath said input for forcefully agitating refuse dropped thereon;
grating means disposed beneath said spindle means for sifting residue and ash, said grating means comprising at least one fixed plate and at least one oscillating plate disposed adjacent said fixed plate;
motor means for forcefully reciprocating said oscillating grating plate;
a plurality of gas heaters disposed within said firebox for burning refuse; and,
auger means disposed at the bottom of said furnace for removing ashes;
afterburner means for withdrawing exhaust gases from said furnace, said afterburner means comprising a rigid manifold divided into first and second adjacent, interior compartments by a perforated partition plate, a first pipe extending between said firebox and said manifold first compartment, a second pipe extending between said annulus and said manifold second compartment;
scrubber means for cleaning exhaust gases withdrawn from said afterburner means; and,
fan means for withdrawing gases from said furnace and said manifold and for forcing gases into said scrubber means.

10. The incinerator as defined in claim 9 wherein said first manifold compartment is disposed between said second manifold compartment and said first pipe.

11. The incinerator as defined in claim 10 wherein the volume of said first manifold compartment is less than the volume of said second manifold compartment.

12. The incinerator as defined in claim 11 including heat exchanger means disposed between said second manifold compartment and said fan means for precooling gases to be scrubbed.

13. The incinerator as defined in claim 12 wherein said scrubber means comprises:
a water recirculating tank;
an elongated, vertical ram pipe in fluid flow communication with said recirculating tank;
means for spraying water to scrub gases transmitted by said ram pipe; and,
means for recirculating water between said tank and said means for spraying.

14. The incinerator as defined in claim 13 including means for withdrawing spent water from said recirculating tank and inputting it into said furnace for disposal.

15. An incineration system comprising:
a rigid, upright furnace adapted to be disposed upon a supporting surface, said furnace having a rigid, generally cubical, top and a lower tapered bottom, said furnace comprising:
a rigid, outer casing;
a rigid fire box generally concentrically disposed within said casing;
a cooling annulus defined between said outer casing and said firebox;
a firebox input for receiving refuse to be incinerated;
a lower ash output for exhausting processed waste;
spindle means disposed within said firebox for forcefully agitating refuse dropped thereon;
grating means for sifting residue and ash, said grating means disposed within said firebox and comprising a fixed plate and an oscillating plate slidably disposed over said fixed plate;
a plurality of gas heaters disposed within said firebox for burning said refuse; and,
auger means disposed at the bottom of said firebox for conveying spent ashes outwardly of said furnace;
afterburner means for withdrawing exhaust gases from said furnace, said afterburner means comprising:
a baffled manifold coupled to said furnace, said manifold comprising a rigid enclosure divided into first and second adjacent, interior compartments by a perforated partition plate, and,
a first pipe extending between said firebox and said manifold first compartment and a second pipe extending between said annulus and said manifold second compartment;
scrubber means for cleaning exhaust gases withdrawn from said afterburner means;
fan means for withdrawing gases from said manifold and forcing gases into said scrubber system; and,
means for withdrawing spent water from said scrubber means and inputting it into said firebox for disposal.

16. The incinerator as defined in claim 15 wherein the volume of said first manifold compartment is less than the volume of said second manifold compartment.

17. The incinerator as defined in claim 16 wherein the diameter of said first pipe is greater than the diameter of said second pipe.

18. The incinerator as defined in claim 17 wherein the diameter manifold compartment is disposed between said second manifold compartment and said first pipe.

* * * * *